US007367726B2

(12) United States Patent
Son et al.

(10) Patent No.: US 7,367,726 B2
(45) Date of Patent: May 6, 2008

(54) THERMAL IMAGE FORMING APPARATUS

(75) Inventors: Myung-Bo Son, Anyang-si (KR); Dong-Hun Han, Suwon-Si (KR); Yong-Duk Lee, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 437 days.

(21) Appl. No.: 11/207,881

(22) Filed: Aug. 22, 2005

(65) Prior Publication Data

US 2006/0115311 A1 Jun. 1, 2006

(30) Foreign Application Priority Data

Nov. 26, 2004 (KR) ..... 10-2004-0097992

(51) Int. Cl.
*B41J 3/60* (2006.01)

(52) U.S. Cl. ..... 400/188; 400/120.16; 347/197

(58) Field of Classification Search ..... None
See application file for complete search history.

(56) References Cited

U.S. PATENT DOCUMENTS

| | | | | |
|---|---|---|---|---|
| 5,085,533 | A * | 2/1992 | Kitahara et al. | 400/652 |
| 6,061,076 | A | 5/2000 | Ishii et al. | |
| 6,682,239 | B2 * | 1/2004 | Mori et al. | 400/649 |
| 2002/0001027 | A1 | 1/2002 | Sugioka et al. | |
| 2006/0115311 | A1 * | 6/2006 | Son et al. | 400/120.17 |
| 2006/0290771 | A1 * | 12/2006 | Han | 347/220 |

FOREIGN PATENT DOCUMENTS

| | | |
|---|---|---|
| EP | 1 550 559 | 7/2005 |
| FR | 2 773 547 | 1/1998 |
| JP | 04-197670 | 7/1992 |
| JP | 07-076139 | 3/1995 |
| JP | 08 237452 | 9/1996 |
| JP | 08-281979 | 10/1996 |
| JP | 11-245433 | 9/1999 |
| JP | 2001-310503 | 11/2001 |
| JP | 2002-059600 | 2/2002 |
| JP | 2003-103866 | 4/2003 |
| JP | 2004-082355 | 3/2004 |
| KR | 1992-14930 | 8/1992 |

* cited by examiner

*Primary Examiner*—Daniel J. Colilla
(74) *Attorney, Agent, or Firm*—Roylance, Abrams, Berdo & Goodman, LLP

(57) ABSTRACT

A thermal image forming apparatus includes a platen roller which supports a medium, a print head, including a heating unit which applies heat to the medium to form an image thereon, which rotates around the platen roller and moves the heating unit to a first location facing a first surface of the medium and a second location facing a second surface of the medium, and a restricting element which rotates together with the print head. The restricting element restricts the movement of the platen roller in a transport direction of the medium so that the heating unit is placed at a printing nip formed by the platen roller and the print head when the print head is located at the first and second locations.

20 Claims, 11 Drawing Sheets

THERMAL IMAGE FORMING APPARATUS

This application claims the priority of Korean Patent Application No. 10-2004-0097992, filed on Nov. 26, 2004, the entire disclosure of which is hereby incorporated by reference.

BACKGROUND OF THE INVENTION

1. Field of the Invention

The present invention relates to an image forming apparatus. More particularly, the present invention relates to a thermal image forming apparatus which forms images on both sides of a medium.

2. Description of the Related Art

To print images on both sides of a medium, an image forming apparatus can be devised to include two print heads on opposite sides of the medium. However, this will increase manufacturing and operational costs of the image forming apparatus. An image forming apparatus can also be devised to include a single print head in which first and second surfaces of a medium are sequentially presented to the print head for double-sided printing. In this case, the print head is fixed while the medium rotates, or the print head moves between the two surfaces of the medium.

Accordingly, there is a need for an improved thermal image forming apparatus including a print head which moves to first and second locations to face first and second surfaces of a medium to print an image on both sides of the medium.

SUMMARY OF THE INVENTION

An aspect of the present invention is to solve at least the above problems and/or disadvantages and to provide at least the advantages described below. Accordingly, an aspect of the present invention is to provide a thermal image forming apparatus including a print head which moves to first and second locations to face first and second surfaces of a medium to print an image on both sides of the medium.

According to an aspect of the present invention, there is provided a thermal image forming apparatus which includes a platen roller to support a medium, a print head including a heating unit which applies heat to the medium to form an image thereon, the print head rotates around the platen roller in order to face the heating unit in a first location to face a first surface of the medium and in a second location to face a second surface of the medium, and a restricting element which rotates together with the print head to restrict movement of the platen roller in a transport direction of the medium so that the heating unit is placed at a printing nip formed by the platen roller and the print head when the print head is located at the first and second locations.

According to another aspect, the thermal image forming apparatus may further include a transport unit which is placed on a reference line which passes a center of the platen roller, and which transports the medium. The locations of the heating unit when the print head is at the first and second locations are symmetrical with respect to the reference line, which passes through the transport unit and the center of the platen roller. A center of rotation of the print head is the intersection of a normal line that passes through the heating unit and the reference line, and the center of the platen roller deviates from the center of rotation of the print head. The platen roller includes a first end having a first diameter and the restricting element comprises first and second restrictors which restrict the movement of the platen roller in the transport direction of the medium. The first and second restrictors contact the first end of the platen roller when the print head is located at the first and second locations. A distance between the first and second restrictors is longer than the first diameter. The distance is about the same as a distance the center of rotation of the print head deviates from the center of the platen roller.

According to another aspect, the print head moves to the first and second locations by rotating about 180°.

According to yet another aspect, the thermal image forming apparatus further includes a heat sink which emits heat which is coupled to the print head wherein the restricting element is formed as a single body with the heat sink.

According to still yet another aspect, the thermal image forming apparatus may further include bushings having inner circumferences into which both ends of the platen roller are inserted, and which rotatably support the platen roller. The inner circumferences are formed as slots to allow the platen roller to move in the transport direction of the medium. The slots increase in size in the transport direction of the medium.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
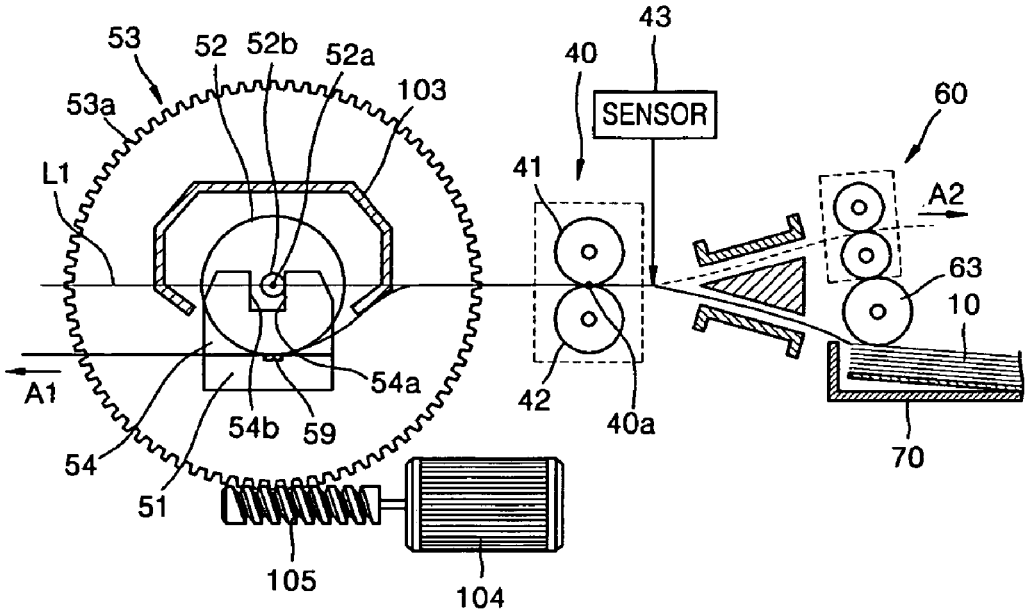
FIGS. 1 and 2 are cross-sections of a thermal image forming apparatus according to an exemplary embodiment of the present invention.
Figure 2:
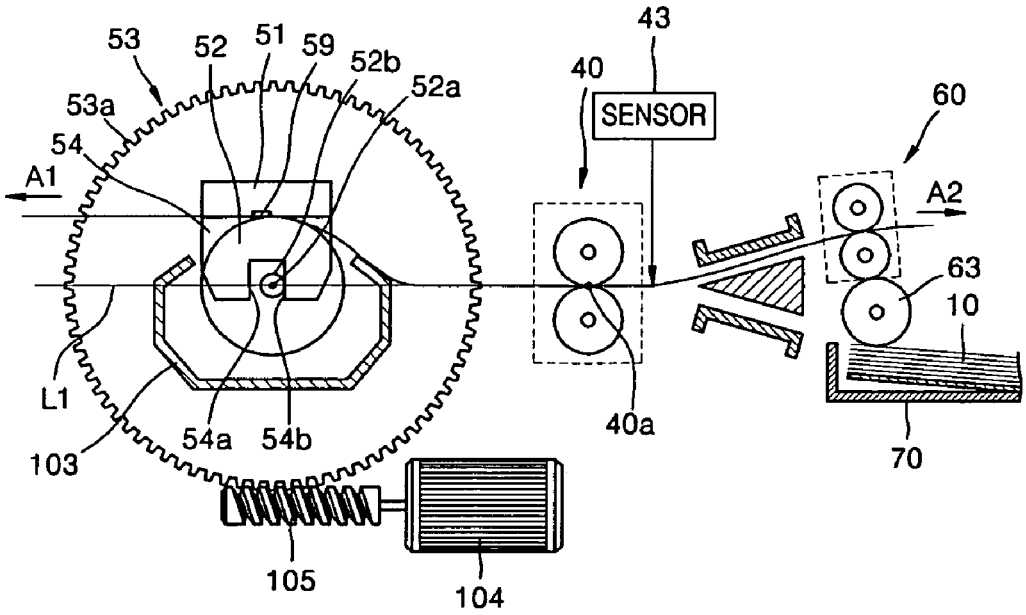

As illustrated in FIGS. 1 and 2, the thermal image forming apparatus includes a print head 51 and a platen roller 52 facing the print head 51 to support a medium 10 and form a printing nip. The print head 51 rotates around the platen roller 52 and moves to a first location (see FIG. 1) facing a first surface of the medium 10 and a second location (see FIG. 2) facing a second surface of the medium 10. FIGS. 1 and 2 are examples illustrating the structure of the thermal image forming apparatus for moving the print head 51 to the first and second locations. The print head 51 is coupled to a support bracket 53. A gear 53*a* is formed on the outer circumference of the support bracket 53. A motor 104 includes a worm gear 105 that meshes with the gear 53*a*. When the support bracket 53 rotates via the motor 104, the print head 51 rotates around the platen roller 52 and moves to the first and second locations.

A transport unit 40 transports the medium 10. The medium 10 is picked up by a pickup roller 63 from a cassette 70 and transported in a first direction A1 to a position between the print head 51 and the platen roller 52 via the transport unit 40. When the medium 10 is placed at a predetermined print start location, the transport unit 40 transports the medium 10 in a second direction A2. The print head 51 prints an image on a first surface of the medium 10 by applying heat to the first surface. The medium 10 is temporarily discharged via a discharge unit 60. When the medium 10 has completely passed through the print head 51 and the platen roller 52, the transport unit 40 stops transporting the medium 10. The motor 40 rotates the supporting bracket 53 to place the print head 51 at the second location. The transport unit 40 transports the medium 10 again in the first direction A1 to a position between the print head 51 and the platen roller 51. The second surface of the medium 10 faces the print head 51. When the medium 10 is placed at a predetermined print start location, the transport unit 40 transports the medium 10 in the second direction A2. The print head 51 prints an image on the second surface of the medium 10 by applying heat thereto. The medium is discharged via the discharge unit 60.

Figure 11:
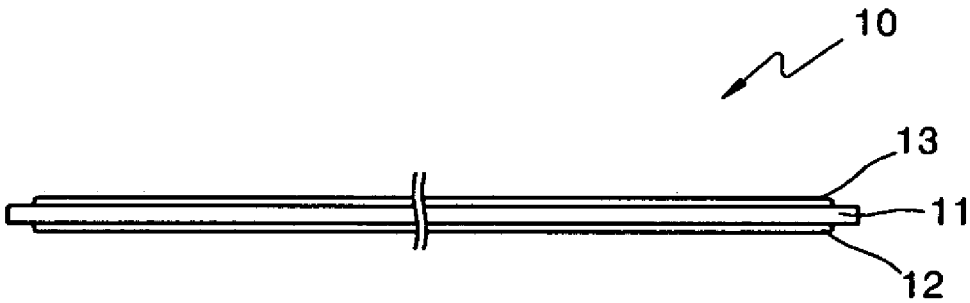
FIG. 11 is a cross-section of an exemplary medium used in the present invention.

The medium 10 used in the present embodiment may have a structure as illustrated in FIG. 11. Ink layers 12 and 13 of predetermined colors are respectively formed on the first and second surfaces of a base sheet 11. The ink layers 12 and 13 may have a single layer structure to produce a single color, or a multi-layer structure to produce multiple colors. As an example, the ink layer 12 on the first surface may comprise two layers to produce yellow and magenta images, and the ink layer 13 on the second surface may comprise a single layer to produce a cyan image. Alternatively, the ink layers 12 and 13 may produce the same colors. The thermal image forming apparatus in the exemplary embodiments of the present invention can print an image on both the first and second surfaces of the medium 10 using a single print head 51. The technical scope of the thermal image forming apparatus is not limited to the structure of the ink layers 12 and 13 on the first and second surfaces of the medium.

As an example, the base sheet 11 of the medium 10 can be transparent. An opaque film may be formed on the outer most surface of one of the ink layers 12 and 13, for example, the ink layer 12. The print head 51 located at the first location applies heat to the ink layer 12 to form yellow and magenta images, and moves to the second location and applies heat to the ink layer 13 to form a cyan image. When viewed from the side of the ink layer 13, cyan, magenta, and yellow images are superimposed, thereby forming a full color image.

The thermal image forming apparatus in the exemplary embodiments of the present invention may also be used in double-side printing which prints different images on the first and second surfaces of the medium 10, in which case the base sheet 11 is opaque.

Figure 3:
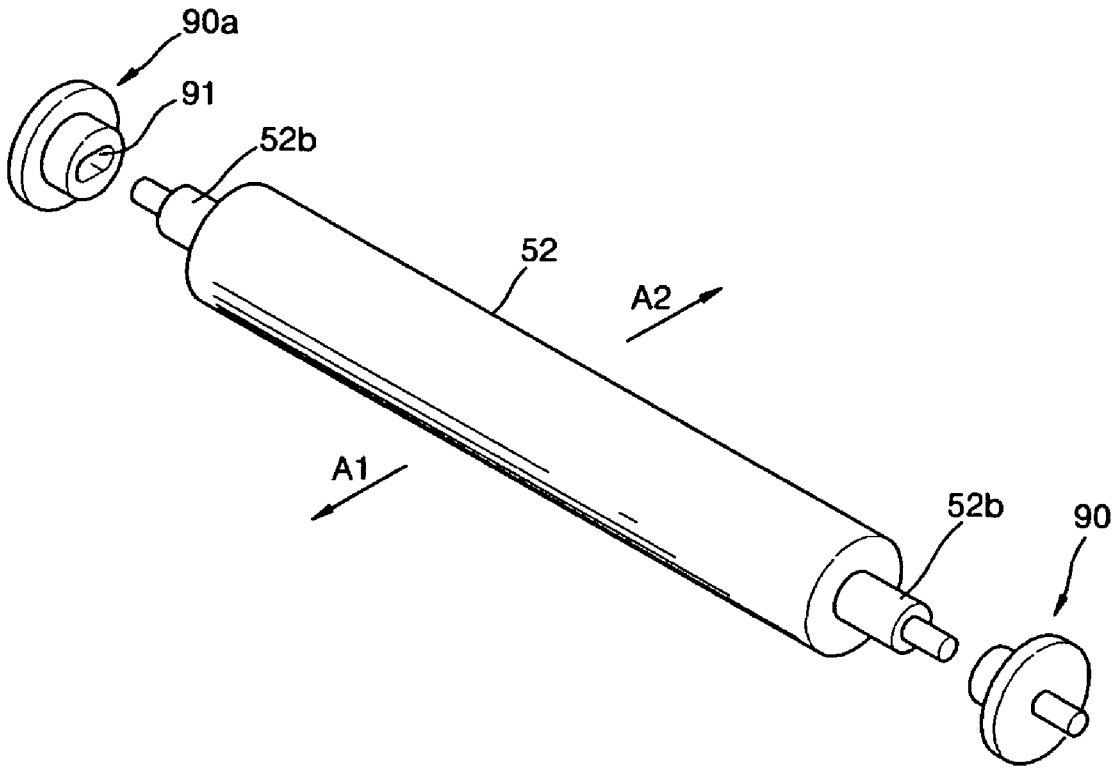
FIGS. 3 and 4 are views of a bushing according to an exemplary embodiment of the present invention.
Figure 4:
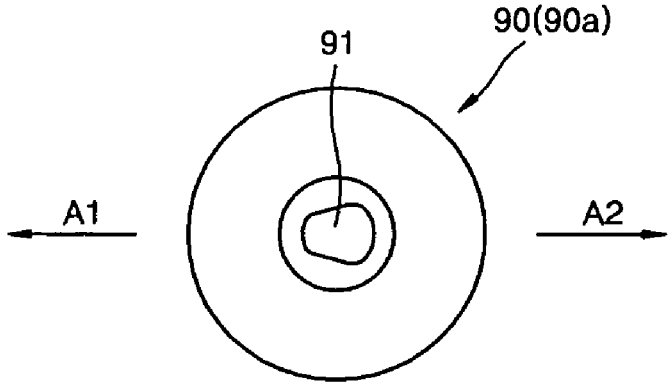

The print head 51 includes a heating unit 59 which applies heat to the medium 10 to form an image thereon. The heating unit 59 must be located at the printing nip formed by the platen roller 52 to effectively apply heat to the medium 10. To ensure this, the thermal image forming apparatus includes a restricting element 54. The restricting element 54 is coupled to the print head 51 and rotates together with the print head 51. The platen roller 52 is rotatably supported by its ends which are inserted into the inner circumferences 91 of bushings 90 and 90*a*, as illustrated in FIG. 3. The platen roller 52 includes first ends 52*b*. The restricting element 54 further includes first and second restrictors 54*a* and 54*b* which limit the movement of the platen roller 52 in the transport direction of the medium 10 by contacting the first ends 52*b* of the platen roller 52 when the print head 51 is located at the first and second locations. When the medium 10 is transported in the second direction A2, the platen roller 52 tends to be dragged in the second direction A2. Therefore, the first and second restrictors 54*a* and 54*b* restrict the movement of the platen roller 52 in the second direction A2. The inner circumferences 91 of the bushings 90 and 90*a* are preferably formed as slots extending in the transport direction of the medium 10, as illustrated in FIG. 3. More preferably, the slots are enlarged in the transport direction of the medium 10, as illustrated in FIG. 4. Referring to FIG. 1, the print head 51 is located at the first location. The first restrictor 54*a* is placed at the first end 52*b* of the platen roller 52 towards the second direction A2, and restricts the platen roller 52 from moving too far in the second direction A2 along the inner circumferences 91 of the bushings 90 and 90*a*. Referring to FIG. 2, the print head 51 is placed at the second location. The second restrictor 54*b* is placed at the first ends 52*b* of the platen roller 52 towards the second direction A2, and restricts the platen roller 52 from moving too far in the second direction A2 along the inner circumferences 91 of the bushings 90 and 90*a*.

To obtain a good quality color image, a print start location of the first and second surfaces must be exactly the same, and yellow, magenta, and cyan color images printed on the first and second surfaces must overlap precisely. The contact position of the heating unit 59 and the platen roller 52 are preferably exactly the same when the print head 51 is at the first and second locations, to print images of the same quality on both sides of the medium 10 and obtain a good quality final image.

To exactly match the print start location of the first and second surfaces of the medium 10 and to make the contact position of the heating unit 59 and the platen roller 52 be the same, the thermal image forming apparatus in the present embodiment places the heating unit 59 symmetrically with respect to a reference line L1 (see FIGS. 1 and 2) which connects the transport unit 40 and a center 52*a* of the platen roller 52 when the print head 51 is at the first and second locations. Then, the distance between the heating unit 59 and the transport unit 40, when the print head 51 is at the first location, is equal to the distance between the heating unit 59 and the transport unit 40 when the print head 51 is at the second location. Thus, the print start location can be easily matched. The transport unit 40 includes a pair of rollers 41 and 42 which rotate in contact with each other. Here, the reference line L1 connects a contact point 40*a* of the pair of rollers 41 and 42 with the center 52*a* of the platen roller 52.

More particularly, when the print head 51 is at the first location, the transport unit 40 transports the medium 10 picked up from the cassette 70 in the first direction A1. The transport unit 40 stops transporting the medium 10 when the trailing end of the medium 10 passes a sensor 43. Then, the transport unit 40 transports the medium 10 in the second direction A2. The medium 10 reaches the print start location when the medium 10 is transported in the second direction A2 for a predetermined period of time after the trailing end of the medium 10 passes the sensor 43 again. In addition, the transport unit 40 transports the medium 10 with an image printed on its first surface in the first direction A1 and stops when the trailing end of the medium 10 passes the sensor 43 when the print head 51 is at the second location. Then, the transport unit 40 transports the medium 10 again in the second direction A2. If the medium 10 is transported for the same period of time in the second direction A2, as the print head 51 is placed at the first location after the trailing end of the medium 10 passes the sensor 43, the medium 10 reaches the print start location. Therefore, the print start location can be precisely matched by a simple control method.

Sine the print head 51 in the thermal image forming apparatus of the present embodiment rotates around the platen roller 52 to move to the first and second locations, it is preferable that the center of rotation of the print head 51 is the center 52*a* of the platen roller 52. For example, if the first and second locations of the platen roller 52 are approximately 180° apart from each other, the heating unit 59, as illustrated as dotted lines in FIG. 5, must be exactly located on a line L2 which passes straight through the center 52*a* of the platen roller when the platen roller 52 is at the first location. This ensures that the heating unit 59 is located symmetrically with respect to the reference line L1 on the line L2 when the print head 51 is located at the second location.

However, the heating unit 59 may have a positional error B due to manufacturing or assembling errors. That is, the print head 51 may be offset from the line L2 when the print head 51 is located at the first location, as illustrated as a solid line in FIG. 5. When the print head 51 rotates approximately 180° around the center 52*a* of the platen roller 52 and is located at the second location, the heating unit 59 is placed at a point symmetrical with respect to the center 52*a* of the platen roller 52, as illustrated by the hatched portion in FIG. 5. Then, the distance between the heating unit 59 and the transport unit 40 is different depending on whether the print head 51 is at the first location or the second location.

Figure 5:
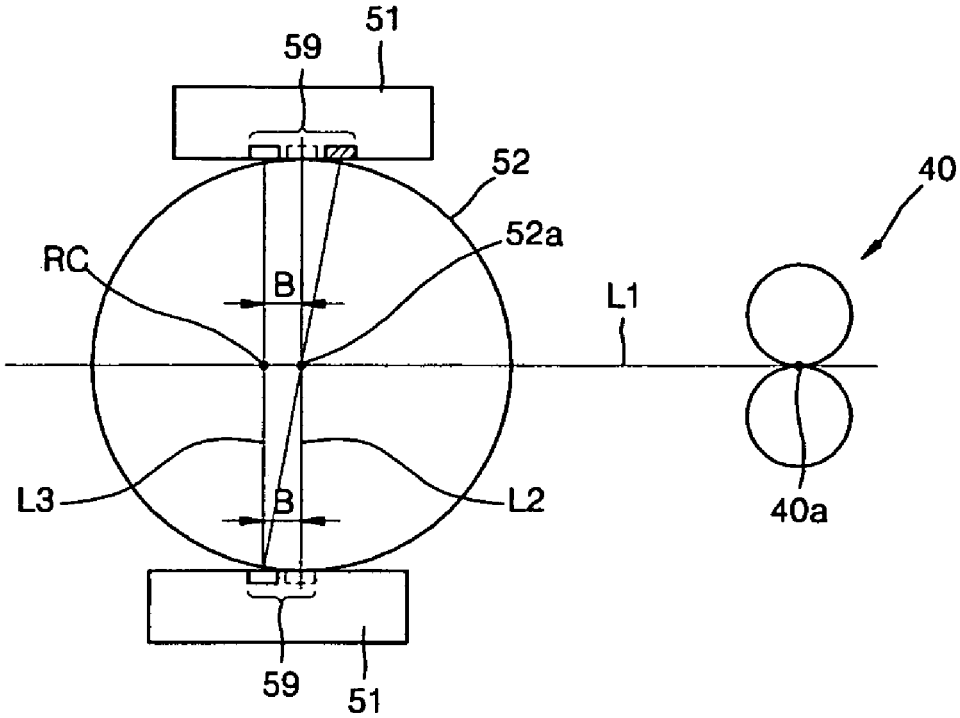
FIGS. 5 and 6 are views for illustrating the center of rotation of a print head.

To solve this problem, a point of intersection of a normal line L3 of the heating unit 59 and the reference line L1 is a center of rotation RC of the print head 51 in the thermal image forming apparatus of the present embodiment. The location of the heating unit 59 is illustrated in FIG. 5 where the print head 51 is at the first location symmetrical with the location of the heating unit 59 when the print head 51 is at the second location with respect to the reference line L1. Therefore, the distance between the heating unit 59 and the transport unit 40 are the same when the print head 51 is at the first location and the second location. In this case, the distance between the first and second restrictors 54*a* and 54*b* is longer than the diameter of the first ends 52*b* of the platen roller 52 by as much as a distance the center 52*a* of the platen roller 52 deviates from the center of rotation RC of the print head 51, as illustrated in FIGS. 1 and 2.

Figure 6:
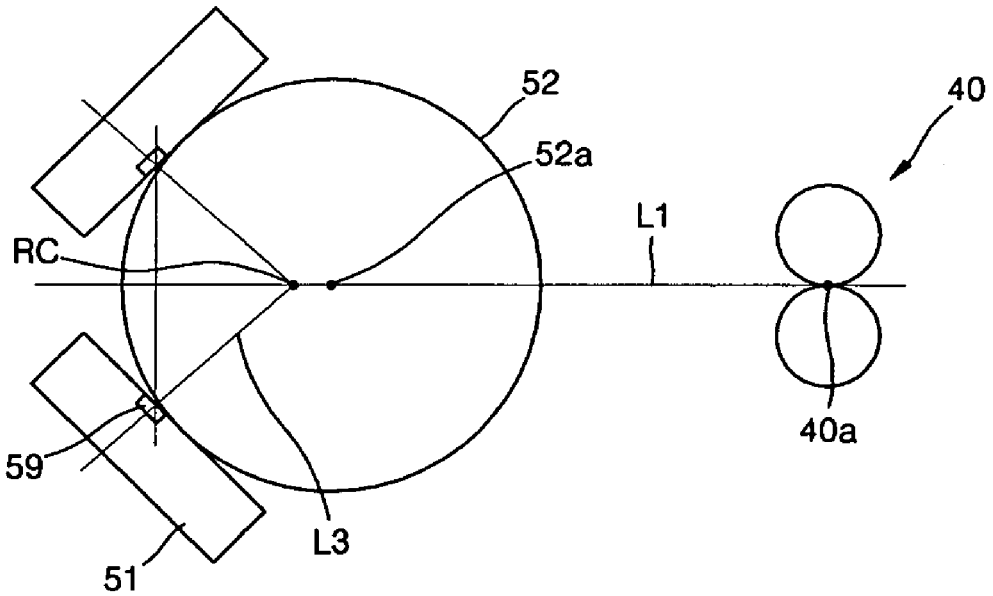

Such movement of the center of rotation RC is not limited to when the first and second locations of the print head 51 are separated by approximately 180°. For example, the point of intersection of the normal line L3 of the heating unit 59 and the reference line L1 is set as a center of rotation RC of the print head 51 even when the first and second locations of the print head 51 are separated by approximately 120°, as illustrated in FIG. 6.

According to the thermal image forming apparatus as described above, the location of the heating unit 59 when the print head 51 is at the first location can be symmetrical to the location of the heating unit 59 when the print head 51 is at the second location, with respect to the reference line L1. This is accomplished by setting the point of intersection of the normal line L3 of the heating unit 59 and the reference line L1 as the center of rotation RC of the print head 51. In addition, the contact condition of the platen roller 52 with the heating unit 59 is the same when the print head 51 is at the first location and the second location. Therefore, the print start location of the print head 51 when it is at the first and second locations can be matched precisely through a simple control method, thereby obtaining a good quality color image.

Figure 7:
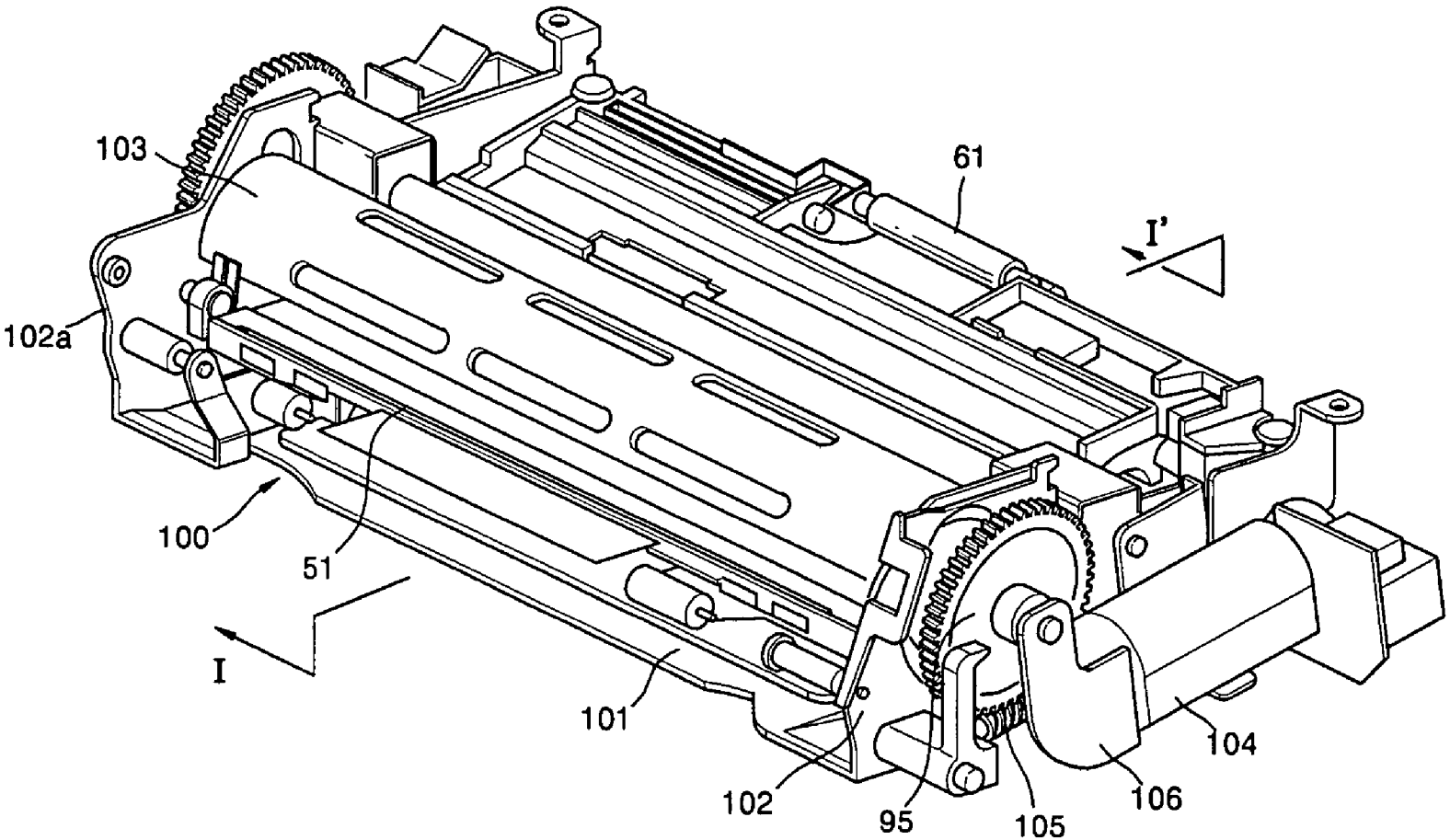
FIG. 7 is a perspective view of a thermal image forming apparatus according to another exemplary embodiment of the present invention.
Figure 8:
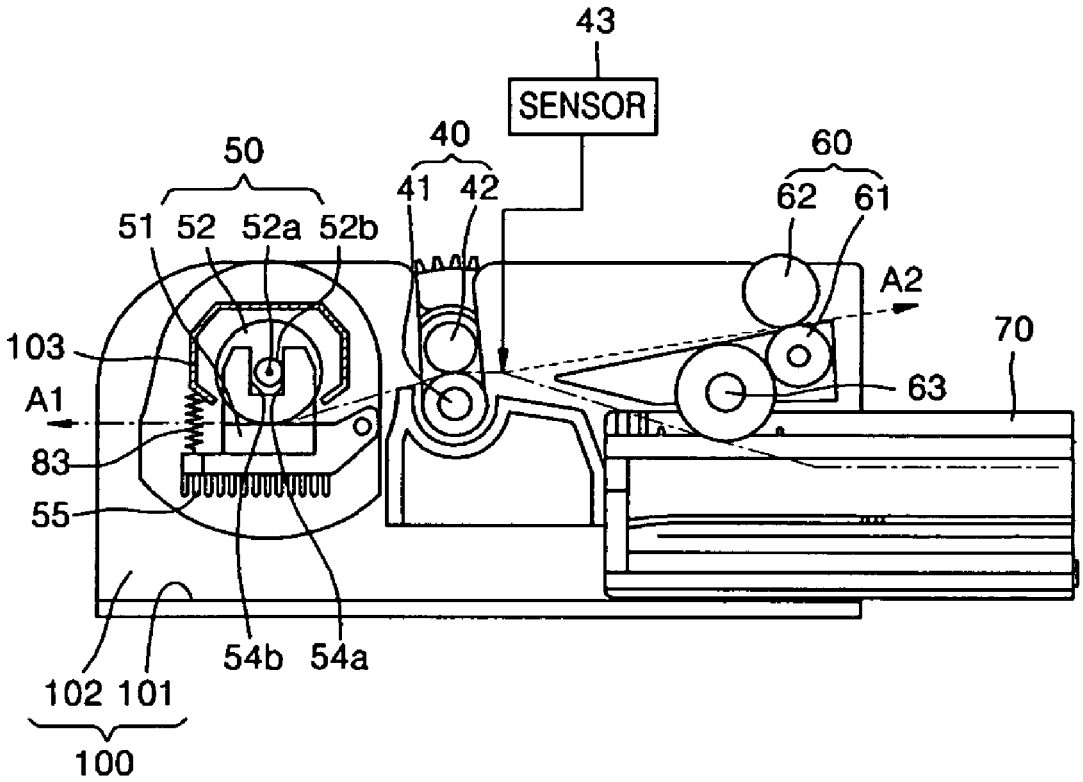
FIG. 8 is a cross-section of the thermal image forming apparatus taken along the line I-I'.
Figure 9:
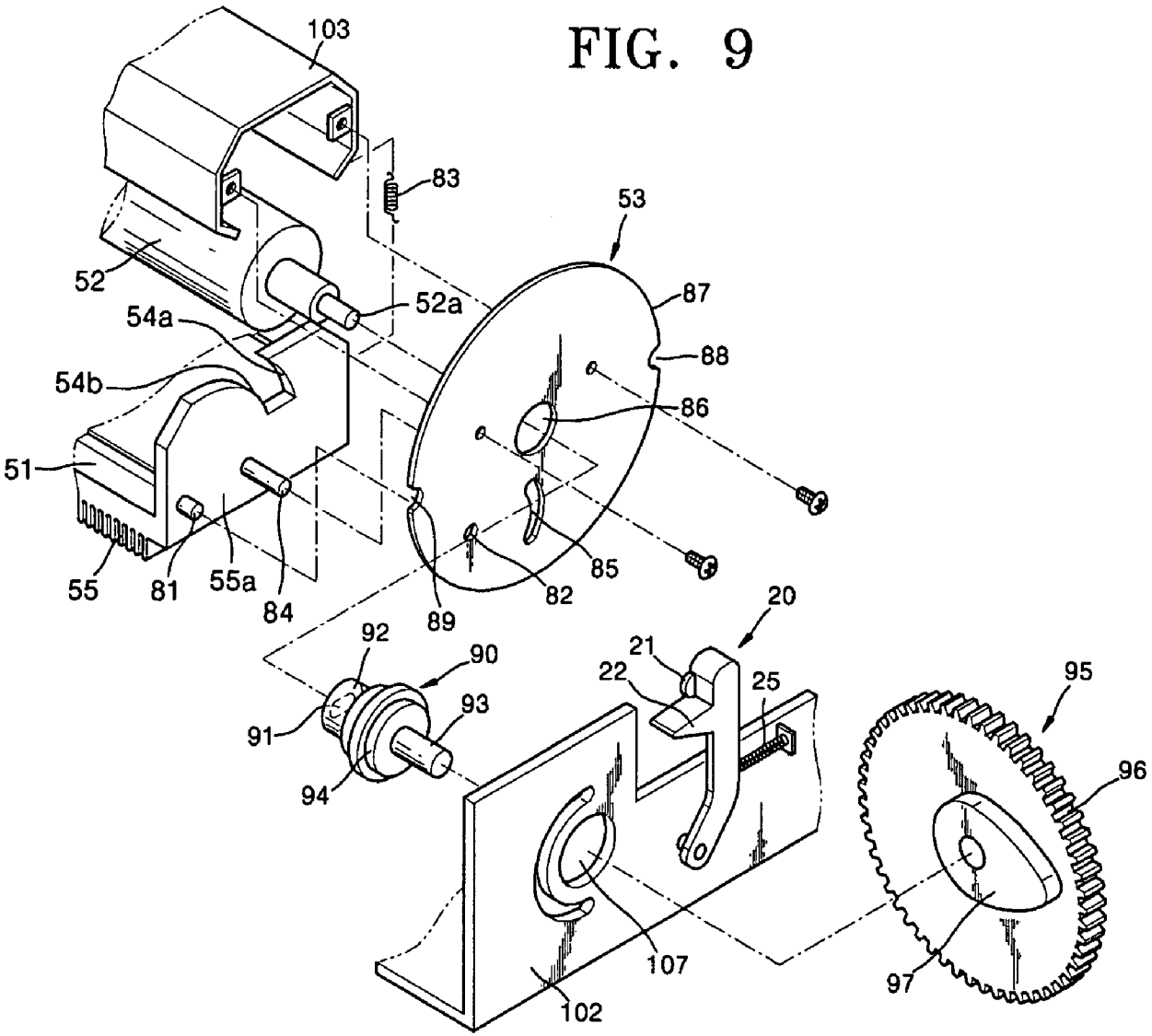
FIG. 9 is an exploded perspective view of the thermal image forming apparatus for illustrating a rotational structure of a print head.

FIG. 7 is a perspective view of a thermal image forming apparatus according to another exemplary embodiment of the present invention. FIG. 8 is a cross-section of the thermal image forming apparatus taken along the line I-I'. FIG. 9 is an exploded perspective view of the thermal image forming apparatus illustrating a structure to move a print head 51 to first and second locations. The method of rotating the print head 51 will be described in more detail in the present exemplary embodiment.

Referring to FIGS. 7 and 8, a frame 100 includes a base 101 with a bottom plate 102 and side plates 102 and 102*a* arranged perpendicular to the base 101. A cassette 70, in which a medium 10 is arranged, is mounted on one side of the frame 100. A pickup roller 63, which picks up the medium 10, is placed above the cassette 70. A discharge unit 60 contacts the pickup roller 63 above the cassette 70, and includes a discharge roller 61 to discharge the medium 10 on which an image is printed and an idle roller 62 that contacts the discharge roller 61. In the present embodiment, the pickup roller 63 and the discharge roller 61 contact each other, and are driven by a single driving motor (not shown). The driving motor may be coupled to the side plate 102*a*. The print head 51 and a platen roller 52 are placed at the opposite side of the discharge unit 60, between the side plates 102 and 102*a*. The medium 10 is transported by a transport unit 40. The transport unit 40 includes a pair of rollers 41 and 42 forced into contact with each other. The rotation force of the driving motor is transmitted to only one of the rollers 41 and 42, which then drives the other.

Referring to FIGS. 7 and 9, the print head 51 is coupled to a pair of support brackets 53. A heat sink 55, which emits heat generated by the print head 51, is coupled to the print head 51. First and second restrictors 54*a* and 54*b* are formed on a sidewall 55*a* of the heat sink 55. Such a structure allows the number of components to be decreased and the manufacturing process to be simplified, since the restricting element 54 of FIGS. 1 and 2 and the heat sink 55 are formed as a single body. A hinge shaft 81 formed on the sidewall 55*a* of the heat sink 55 is inserted into a hinge hole 82 formed on the support bracket 53, and the print head 51 is coupled to the support bracket 53 in a way which enables the print head 51 to rotate around the hinge hole 82. A rotation guide 103 is coupled to the support brackets 53. The print head 51 is elastically biased towards the platen roller 52 by a second elastic element 83. For example, the second elastic element 83 may be an extension spring which has one end coupled to the print head 51 and the other end coupled to the rotation guide 103, which covers the platen roller 52, as illustrated in FIG. 9.

A shaft 84 formed on the sidewall 55*a* of the heat sink 55 is inserted into a through-hole 85 formed on the support bracket 53. Preferably, the through-hole 85 is an arc having the hinge hole 82 as its center, to allow the print head 51 to move in and out of contact with the platen roller 52. In addition, the first and second restrictors 54*a* and 54*b* are preferably formed as arcs with the hinge hole 82 as their center. In the present embodiment, the power of the driving motor is not directly transmitted to the platen roller 52. The platen roller 52 rotates by coming in contact with the medium 10, which is transported by the transport unit 40.

The bushing 90 is coupled to the side plate 102. The bushing 90 includes an inner circumference 91 and a first outer circumference 92, which is eccentric to the inner circumference 91 by as much as the positional error B described in FIGS. 5 and 6, a second outer circumference 93, and a third outer circumference 94. The bushing 90*a* (see FIG. 3) is coupled to the side plate 102*a*. The bushing 90*a* includes an inner circumference 91, a first outer circumference 92, and a third outer circumference 94. Both ends of the platen roller 52 are inserted into each of the inner circumferences 91 of the bushings 90 and 90*a*. Preferably, the inner circumferences 91 of the bushings 90 and 90*a* have a slot form as illustrated in FIGS. 3 and 4, or a slot form enlarged in the transport directions A1 and A2 of the medium 10. The first outer circumference 92 is rotatably inserted into a support hole 86 formed on the support bracket 53. A rotation cam 95 is rotatably coupled to the second outer circumference 93. The rotation cam 95 includes a cam unit 97 which contacts a gear 96 and the shaft 84. A motor 104 (see FIG. 7) includes a worm gear 105 that meshes with the gear 96. A bracket 106, which has the motor connected thereto, is coupled to the side plate 102. The third outer circumferences 94 of the bushings 90 and 90*a* are inserted into a respective hole 107 formed on the side plates 102 and 102*a*. One end of the second circumference 93 of the bushing 90 is supported by the bracket 106. The bracket 106 ensures that the rotation cam 95 does not separate from the second circumference 93. Preferably, the third outer circumference 94 is concentric with the first outer circumference 92. According to the above described structure, the support bracket 53 and the rotation cam 95 both have the same center of rotation, which is the center of rotation RC of the print head 51. The support bracket 53 has a circular outer circumference 87. First and second coupling grooves 88 and 89, separated approximately 180° from each other, are formed on the outer circumference 87. A locking element 20 is pivoted from the side plate 102. A first elastic element 25 applies a force to the locking element 20 towards the first and second coupling grooves 88 and 89. In the present embodiment, the locking element 20 is released from the first and second coupling grooves 88 and 89 by the rotation cam 95, and is coupled with the first and second coupling grooves 88 and 89 by the first elastic element 25. The locking element 20 includes a protrusion 21 that locks into the first and second coupling grooves 88 and 89, and a cam follower 22 which contacts the cam unit 97 of the rotation cam 95.

FIGS. 10A through 10I are views illustrating the rotation operation of the print head 51. Although not specifically shown in FIGS. 10A through 10I, the center of rotation RC of the rotation cam 97 and the support bracket 53 is distanced from the center 52*a* of the platen roller 52 by as much as the positional error B.

Figure 10A:
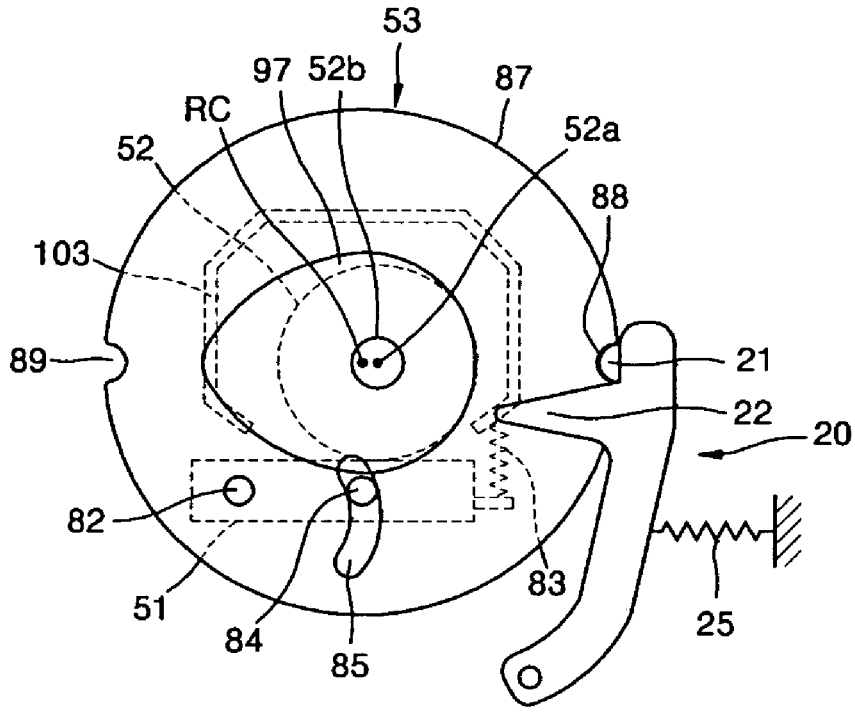
FIGS. 10A through 10I are views illustrating the rotational operation of the print head.

As illustrated in FIG. 10A, the print head 51 is pressed against the platen roller 52. Also, the protrusion 21 of the locking element 20 is locked into the first coupling groove 88. Thus, the print head 51 is locked at the first location. The medium 10 output from the cassette 70 by the pickup roller 63 is transported to the transport unit 40. Preferably, the print head 51 separates from the platen roller 52 before the medium 10 is transported in between the print head 51 and the platen roller 52.

Figure 10B:
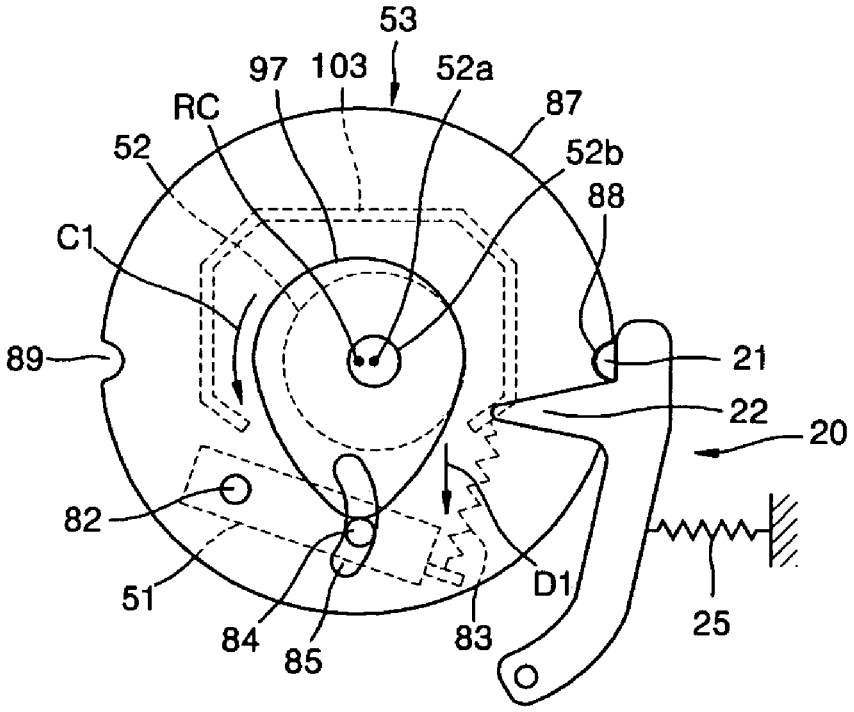

Referring to FIG. 10B, the rotation cam 95 is rotated in a direction C1 and the cam unit 97 pushes the shaft 84. The support bracket 53 does not rotate, since the protrusion 21 of the locking element 20 is locked into the first coupling groove 88. The print head 51 rotates around the hinge hole 82 and separates from the platen roller 52 when the shaft 84 is pushed in a direction D1 along the through-hole 85. Here, the print head 51 can rotate freely without interference from a first end 52*b* of the platen roller 52 since the first and second restrictors 54*a* and 54*b* have arc forms, as illustrated in FIG. 9. In this state, the transport unit 40 transports the medium 10 in the first direction A1 and supplies the medium 10 between the print head 51 and the platen roller 52. The medium 10 is input between the print head 51 and the platen roller 52 without resistance even if the platen roller 52 does not rotate, because the print head 51 and the platen roller 52 are separated.

Figure 10C:
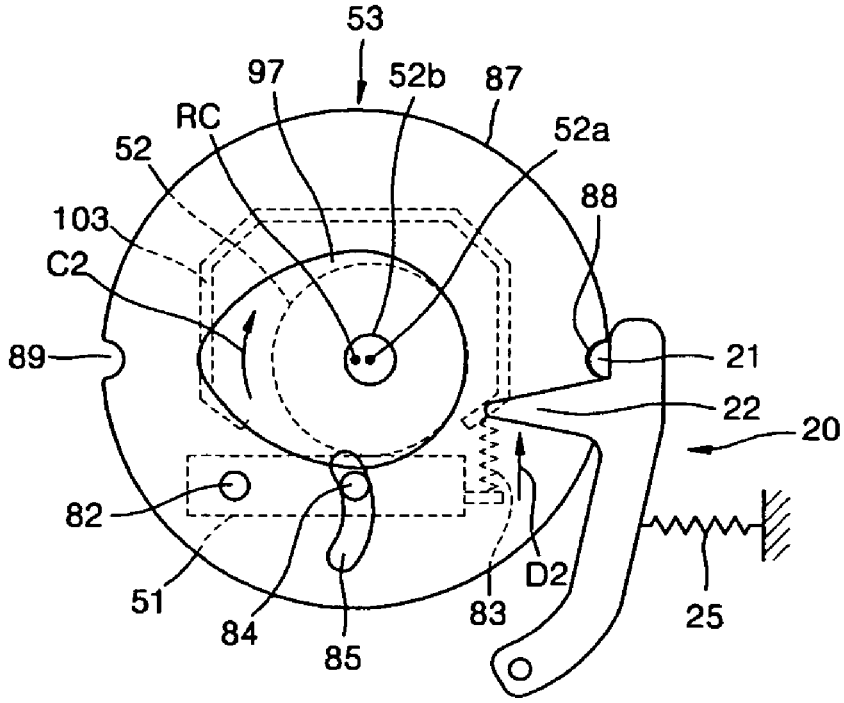

When the trailing end of the medium 10 passes the sensor 43, the transport unit 40 stops transporting the medium 10. Referring to FIG. 10C, the rotation cam 95 rotates in a direction C2. The support bracket 53 does not rotate, since the protrusion 21 of the locking element 20 is locked into the first coupling groove 88. The print head 51 is rotated in a direction D2 around the hinge hole 82 by the elastic force of the second elastic element 83 and is forced into contact with the platen roller 52.

From here, the transport unit 40 starts to transport the medium 10 in the second direction A2. The platen roller 52 tends to be dragged in the second direction A2. The first restrictor 54*a* contacts the first end 52*b* of the platen roller 52 to restrict the platen roller 52 from being dragged too far. Therefore, the heating unit 59 of the print head 51 is located at a printing nip formed by the platen roller 52. A predetermined period of time after the trailing end of the medium 10 again passes the sensor 43, the medium 10 is located at the print start location and the print head 51 applies heat to the first surface of the medium 10 to print magenta and yellow images. The magenta and yellow images are selectively produced, depending on, for example, the temperature and heating time of the print head 51. For example, the magenta image can be formed by applying a high temperature heat for a short time, and the yellow image can be formed by applying a low temperature heat for a long time. The discharge unit 60 temporarily discharges the medium 10. After printing on the first surface of the medium 10 is completed, the transport unit 40 stops transporting the medium 10.

Now, the process of moving the print head 51 to the second location to print an image on the second surface of the medium 10 is performed.

Figure 10D:
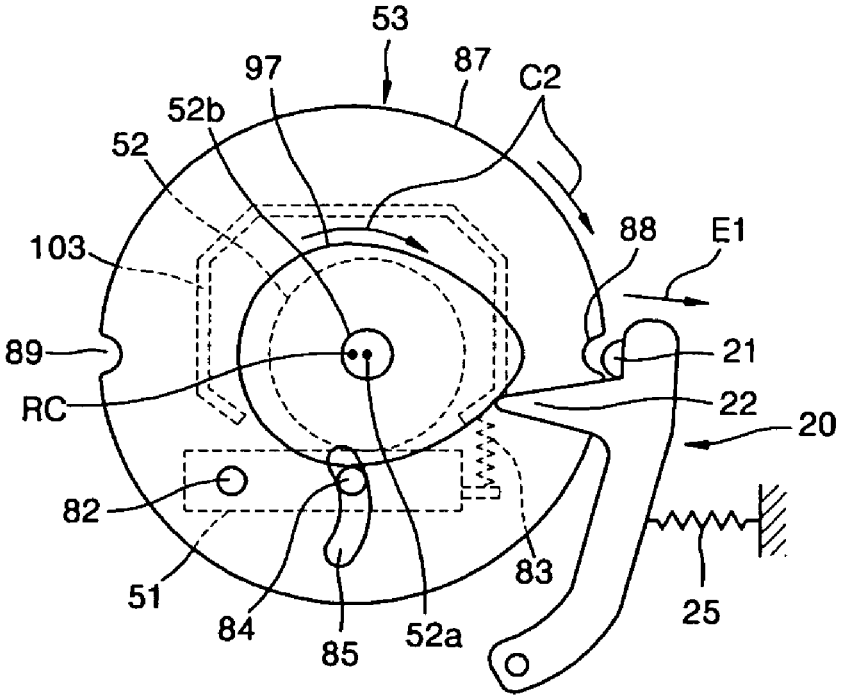
Figure 10E:
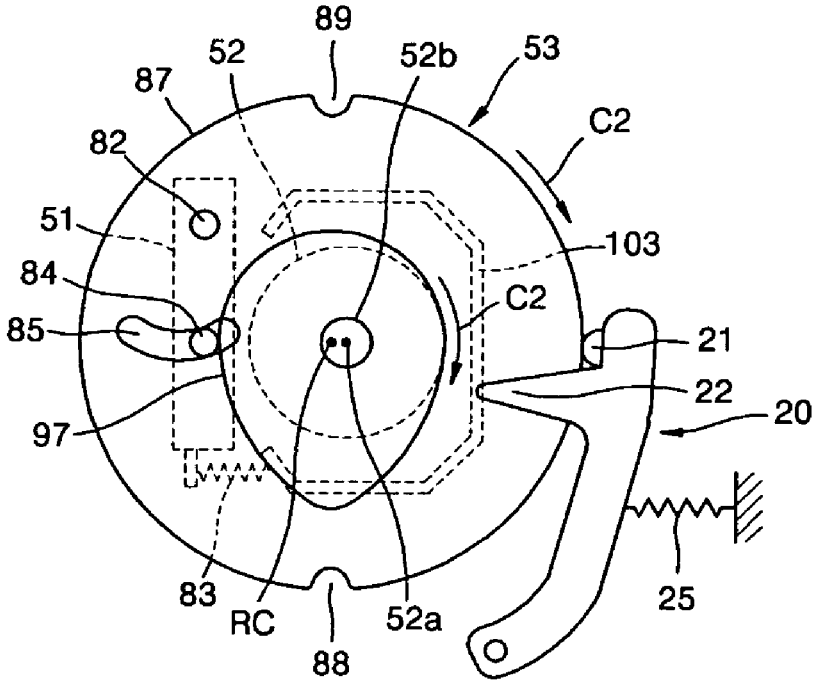

Referring to FIG. 10D, the cam unit 97 pushes the cam follower 22 and pivots the locking element 20 in a direction E1 when the rotation cam 95 is rotated in the direction C2. Then, the protrusion 21 separates from the first coupling groove 88, releasing the support bracket 53 so it can rotate freely. Therefore, the cam unit 97 continues to rotate in the C2 direction and pushes the shaft 84. Then, as illustrated in FIG. 10E, the support bracket 53 rotates in the direction C2 instead of pushing the print head 51 in the direction D1. While the support bracket 53 rotates in the direction C2, the cam unit 97 pushes the shaft 84. Therefore, the print head 51 may actually separate slightly from the platen roller 52. When the cam unit 97 no longer contacts the cam follower 22, the locking element 20 continuously contacts the outer circumference 87 of the support bracket 53 due to the elastic force of the first elastic element 25.

Figure 10F:
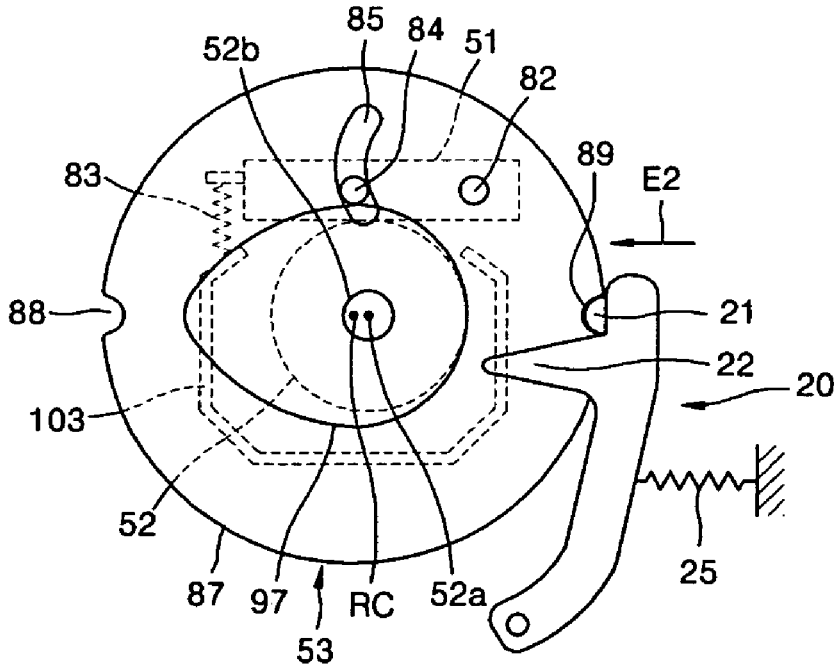

After the support bracket 53 has rotated, for example, approximately 180°, the locking element 20 rotates in a direction E2 due to the elastic force of the first elastic element 25, the protrusion 21 locks into the second coupling groove 89, and the support bracket 53 locks and does not rotate, as illustrated in FIG. 10F. The print head 51 is placed in the second location facing the second surface of the medium 10. Since the center of rotation RC of the print head 51 is different from the center 52*a* of the platen roller 52, the location of the heating unit 59 when the print head 51 is in the first location is symmetrical to the location of the heating unit 59 when the print head 51 is in the second location, with respect to the reference line L1. Therefore, the distance between the heating unit 59 and the transport unit 40 is the same when the print head 51 is in the first location and the second location.

Figure 10G:
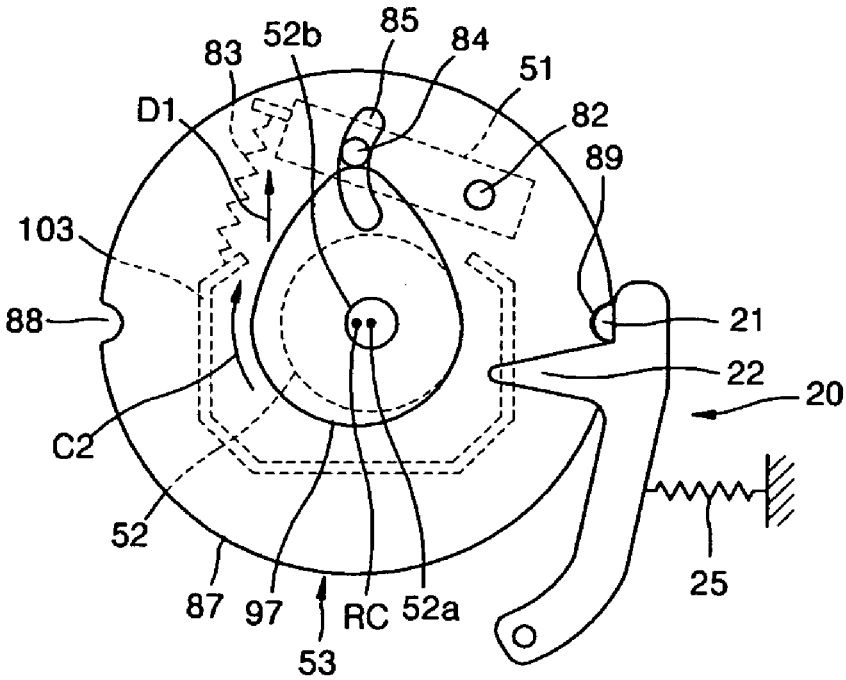

Even when the rotation cam 95 continues to rotate in the direction C2, the support bracket 53 does not rotate, because the protrusion 21 locks into the second coupling groove 89. Instead, as illustrated in FIG. 10G, the print head 51 separates from the platen roller 52 as the shaft 84 pushes along the through-hole 85.

Figure 10H:
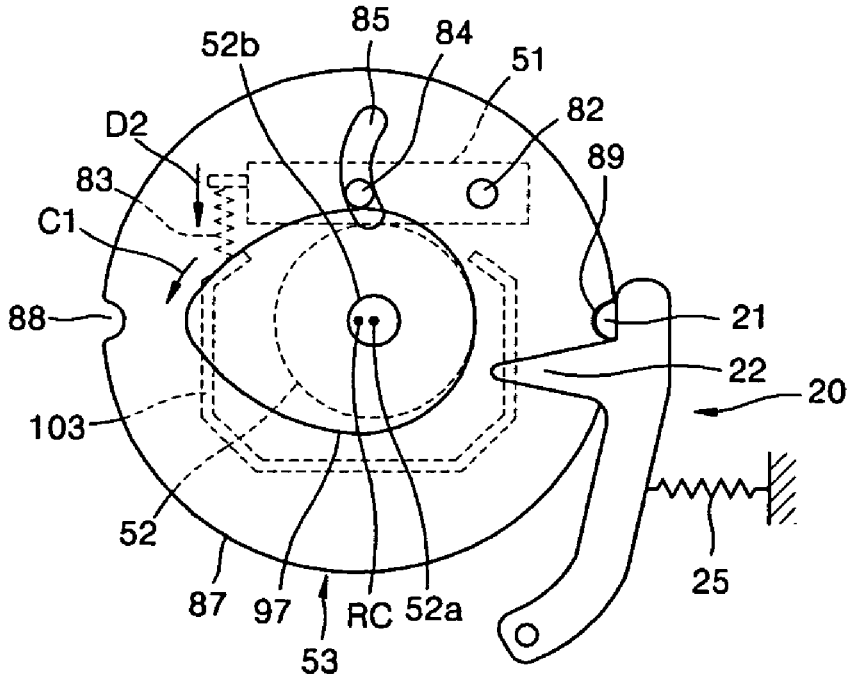

In this state, the transport unit 40 transports the medium 10 in the first direction A1. The transport unit 40 stops after the trailing end of the medium 10 passes the sensor 43. When the rotation cam 95 rotates in the direction C1, the support bracket 53 does not rotate, since the protrusion 21 locks into the second coupling groove 89. Instead, as illustrated in FIG. 10H, the print head 551 comes into contact with the platen roller 52 as the shaft 84 returns along the through-hole 85.

The transport unit 40 transports the medium 10 again in the second direction A2. The platen roller 52 tends to drag in the second direction A2. The second restrictor 54*b* contacting the first end 52*b* of the platen roller 52 restricts the platen roller 52 from being dragged too far. Therefore, the heating unit 59 of the print head 51 is placed at the printing nip formed by the platen roller 52. A predetermined period of time after the trailing end of the medium 10 again passes the sensor 43, the print head 51 applies heat to the second surface of the medium 10, to print a cyan image on the medium 10. The medium 10 printed on both surfaces is then discharged to outside the thermal image forming apparatus via the discharge unit 60.

Figure 10I:
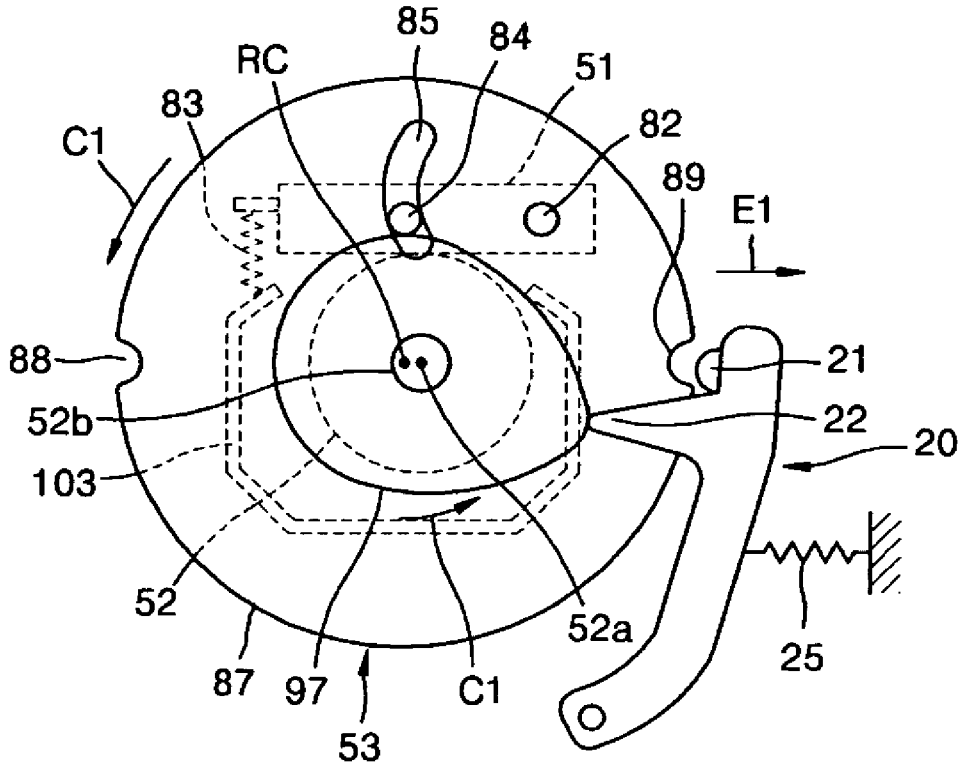

When the image printing is finished, the rotation cam 95 rotates in the direction C1, as illustrated in FIG. 10I. The cam unit 97 pushes the cam follower 22 and pivots the locking element 20 in the direction E1. Then, the protrusion 21 is released from the second coupling groove 89 and the support bracket 53 is released so it can rotate freely. When the cam unit 97 pushes the shaft 84, the support bracket 53 rotates until the protrusion 21 locks into the first coupling groove 88 by the elastic force of the first elastic element 25. Then, the print head 51 returns to the first location as illustrated in FIG. 10A. The print head 51 can standby for the next printing operation in the state as illustrated in FIG. 10A, or in the state where the printing head 51 separates from the platen roller 52 as illustrated in FIG. 10B.

According to the above-described structure, if the base sheet 11 of the medium 10 is transparent, cyan, magenta, and yellow images are superimposed to form a full color image. If the base sheet 11 is opaque, double-side printing is possible by printing different images on the first and second surfaces of the medium 10.

The above-described thermal image forming apparatus according to the exemplary embodiments of the present invention achieves the following benefits.

First, a restricting element ensures that a print head is always placed at a printing nip formed by a platen roller, even when the location of the print head changes to a first or second location.

Second, it is easier to match a print start location by locating the first and second locations symmetrically with respect to a reference line.

Third, a contact condition of a platen roller with a heating unit can be identical whether the print head is located at the first or second location, by making a center of rotation of the print head different to a center of the platen roller.

Fourth, the number of components can be decreased and the manufacturing process simplified, by forming a heat sink and the restricting element in a single body.

Fifth, by forming an inner circumference of bushings as a slot or a slot enlarged in a transport direction of a medium, the platen roller can readily move until it is restricted by the restricting element.

Sixth, a transport path of the medium is simplified and the thermal image forming apparatus is more reliable, since the print head rotates. Also, the thermal image forming apparatus can be smaller than a conventional printer.

While the invention has been shown and described with reference to certain embodiments thereof, it will be understood by those skilled in the art that various changes in form and details may be made therein without departing from the spirit and scope of the invention as defined by the appended claims.

What is claimed is:

1. A thermal image forming apparatus, comprising:

a platen roller which supports a medium;

a print head including a heating unit which applies heat to the medium to form an image thereon, the print head rotates around the platen roller in order to face the heating unit in a first location to face a first surface of the medium and in a second location to face a second surface of the medium; and a restricting element which rotates together with the print head to restrict the movement of the platen roller in a transport direction of the medium so that the heating unit is placed at a printing nip formed by the platen roller and the print head when the print head is located in the first and second locations.

2. The thermal image forming apparatus of claim 1, wherein the print head rotates about 180° to move to the first and second locations.

3. The thermal image forming apparatus of claim 1, further comprising a heat sink, which emits heat, coupled to the print head, wherein the restricting element is formed as a single body with the heat sink.

4. The thermal image forming apparatus of claim 1, further comprising bushings which have inner circumferences into which both ends of the platen roller are inserted to rotatably support the platen roller, wherein the inner circumferences are formed as slots to allow the platen roller to move in the transport direction of the medium.

5. The thermal image forming apparatus of claim 4, wherein the inner circumferences are formed as slots which increase in size in the transport direction of the medium.

6. The thermal image forming apparatus of claim 1, further comprising a transport unit which is placed on a reference line which passes a center of the platen roller and which transports the medium, wherein locations of the heating unit when the print head is at the first and second locations are symmetrical with respect to the reference line, which passes through the transport unit and the center of the platen roller.

7. The thermal image forming apparatus of claim 6, wherein a center of rotation of the print head is the intersection of a normal line that passes through the heating unit and the reference line, and the center of the platen roller deviates from the center of rotation of the print head.

8. The thermal image forming apparatus of claim 7, wherein the platen roller comprises a first end having a first diameter; and the restricting element comprises first and second restrictors which restrict the movement of the platen roller in the transport direction of the medium by contacting the first end of the platen roller when the print head is located in the first and second locations, wherein a distance between the first and second restrictors is longer than the first diameter by as much as a distance the center of rotation of the print head deviates from the center of the platen roller.

9. The thermal image forming apparatus of claim 8, wherein the print head moves to the first and second locations by rotating about 180°.

10. The thermal image forming apparatus of claim 9, further comprising a heat sink which emits heat, coupled to the print head, wherein the restricting element is formed as a single body with the heat sink.

11. The thermal image forming apparatus of claim 8, further comprising bushings having inner circumferences into which both ends of the platen roller are inserted, and which rotatably support the platen roller, wherein the inner circumferences are formed as slots to allow the platen roller to move in the transport direction of the medium.

12. The thermal image forming apparatus of claim 11, wherein the inner circumferences are formed as slots which increase in size in the transport direction of the medium.

13. A thermal image forming apparatus, comprising:

a platen roller which supports a medium;

a print head including a heating unit which applies heat to the medium to form an image thereon, the print head rotates around the platen roller in order to face the heating unit in a first location to face a first surface of the medium and in a second location to face a second surface of the medium;

a heat sink which emits heat coupled to the print head;

a transport unit located on a reference line which passes a center of the platen roller and which transports the medium; and a restricting element which rotates together with the print head to restrict the movement of the platen roller in a transport direction of the medium so that the heating unit is placed at a printing nip formed by the platen roller and the print head when the print head is located in the first and second locations.

14. The thermal image forming apparatus of claim 13, wherein locations of the heating unit when the print head is at the first and second locations are symmetrical with respect to the reference line, which passes through the transport unit and the center of the platen roller.

15. The thermal image forming apparatus of claim 14, wherein a center of rotation of the print head is the intersection of a normal line that passes through the heating unit and the reference line, and the center of the platen roller deviates from the center of rotation of the print head.

16. The thermal image forming apparatus of claim 15, wherein the platen roller comprises a first end having a first diameter; and the restricting element comprises first and second restrictors which restrict the movement of the platen roller in the transport direction of the medium by contacting the first end of the platen roller when the print head is located in the first and second locations, wherein a distance between the first and second restrictors is longer than the first diameter by as much as a distance the center of rotation of the print head deviates from the center of the platen roller.

17. The thermal image forming apparatus of claim 16, wherein the print head moves to the first and second locations by rotating about 180°.

18. The thermal image forming apparatus of claim 17, wherein the restricting element is formed as a single body with the heat sink.

19. The thermal image forming apparatus of claim 16, further comprising bushings having inner circumferences into which both ends of the platen roller are inserted, and which rotatably support the platen roller, wherein the inner circumferences are formed as slots to allow the platen roller to move in the transport direction of the medium.

20. A thermal image forming apparatus, comprising:

a platen roller which supports a medium;

a print head including a heating unit which applies heat to the medium to form an image thereon, the print head rotates around the platen roller in order to face the heating unit in a first location to face a first surface of the medium and in a second location to face a second surface of the medium;

a heat sink which emits heat coupled to the print head;

bushings having inner circumferences into which both ends of the platen roller are inserted to rotatably support the platen roller;

a transport unit located on a reference line which passes a center of the platen roller and which transports the medium; and a restricting element which rotates together with the print head to restrict the movement of the platen roller in a transport direction of the medium so that the heating unit is placed at a printing nip formed by the platen roller and the print head when the print head is located in the first and second locations.

* * * * *